United States Patent [19]

Sasamura et al.

[11] Patent Number: 4,841,600

[45] Date of Patent: Jun. 27, 1989

[54] DOOR CHECK AND STOP

[75] Inventors: Ross S. Sasamura; John H. Jewell, II, both of Fremont, Calif.

[73] Assignee: Paccar Inc, Bellevue, Mass.

[21] Appl. No.: 171,554

[22] Filed: Mar. 23, 1988

[51] Int. Cl.[4] ..... E05F 5/06; E05D 11/10

[52] U.S. Cl. ..... 16/335; 16/85; 16/345

[58] Field of Search ..... 16/82, 85, 332, 334, 16/335, 344, 345, 347, 348, 349, 353, 360, 363, 377

[56] References Cited

U.S. PATENT DOCUMENTS

| | | | |
|---|---|---|---|
| 2,074,398 | 3/1937 | Jacobs | 16/85 |
| 2,513,751 | 7/1950 | Semar | 16/85 |
| 3,009,193 | 11/1961 | Lifton | 16/347 |
| 3,911,529 | 10/1975 | Pringle | 16/335 |
| 4,672,715 | 6/1987 | Beckwith | 16/345 X |

*Primary Examiner*—Fred A. Silverberg

*Attorney, Agent, or Firm*—Flehr, Hohbach, Test, Albritton & Herbert

[57] ABSTRACT

A hinge assembly for a vehicle is provided having an internal passageway defined by mated slotted portions of the hinge and the door jamb, check assembly, mounted on the hinge and having a specifically configured free end extending through the passageway, and detent arrangement, mounted on the interior of the door jamb for engagement with the specifically configured free end of the check assembly to restrain rotation of the door in a primary intermediate open position. The specifically configured free end of the check assembly and the detent arrangement cooperated with one another so as to alternatively restrain rotation of the door in the primary intermediate open position and a less open secondary intermediate open position, and the check assembly is formed for releasable engagement with the detent arrangement to permit free rotation of the door to a fully open position.

10 Claims, 4 Drawing Sheets

SECTION A—A

SECTION A—A

SECTION A—A

SECTION B—B

DOOR CHECK AND STOP

FIELD OF THE INVENTION

This invention relates to hinge assemblies for vehicles, and in particular to a hinge assembly which permits selective restraint of the rotation of the vehicle door at two intermediate open positions in the door's range of motion.

BACKGROUND OF THE INVENTION

Typical vehicle door hinges exhibit a common feature or characteristic. The hinges do not hold the door of the vehicle partially open while occupants are entering and exiting the vehicle. When the vehicle is parked or idling on a sloping surface, the door must be held open manually. Typically, the cab doors of trucks, when opened, cannot be restrained in any intermediate position. When fully opened, such cab doors contact the body of the truck thereby providing the potential for damage to the truck body.

For service and maintenance purposes, it is obviously advantageous to be able to open the cab door fully, exposing the working parts of the hinge assembly. However, for user convenience in entering and exiting the vehicle, and for damage minimization, it would be advantageous to provide a hinge assembly which can be opened and restrained at one or more predetermined intermediate open positions as well as opened fully.

It is the principle object of the present invention to provide such a hinge assembly.

It is an additional object of the present invention to provide a hinge assembly having the foregoing characteristic that is also simple to operate and easy and economical to manufacture.

It is a further object of the present invention to provide a hinge assembly having the foregoing characteristics that can be readily adapted for use in hinge assemblies which do not have the foregoing characteristics.

There are other objects and advantages of the present invention, and those will become apparent upon reading the following description in light of the accompanying drawing.

SUMMARY OF THE INVENTION

The present invention relates to a hinge assembly for a vehicle, typically having a door jamb, a door, and a hinge. The hinge is mounted between the door jamb and the door, such that the door is rotatable between closed and fully opened positions. The hinge assembly of the present invention includes a first means movable with the door and a second means connected with the door jamb. The first means and the second means cooperate with one another in three ways. First, they maintain the door open in a first intermediate position. Second, they maintain the door open in a second intermediate position between the first intermediate position and a closed position. Third, they permit the door to move to its fully opened position. More specifically, the first means comprises check means mounted on the hinge and having a specifically configured free end. The second means comprises detent means, mounted on the interior of the door jamb for engagement with the specifically configured free end of the check means, to restrain rotation of the door.

In a preferred form, the check means includes a resiliently deformable metal ribbon attached at one end to the door and having a first curved portion extending therefrom, a second oppositely curved medial portion, and a flanged end. The detent means is formed and positioned for engagement with the flanged end of the metal ribbon in one way when the door is opened to the first intermediate position, and in a second way when the door is opened to the second intermediate position. To permit reciprocation of the metal ribbon, the assembly also includes an internal passageway defined by mated slotted portions of the hinge and the door jamb. As a result of the aforementioned arrangement, and others which will appear from reading the detailed description, an easy to operate hinge assembly not heretofore available is provided.

DETAILED DESCRIPTION OF THE PREFERRED EMBODIMENT

Figure 1:
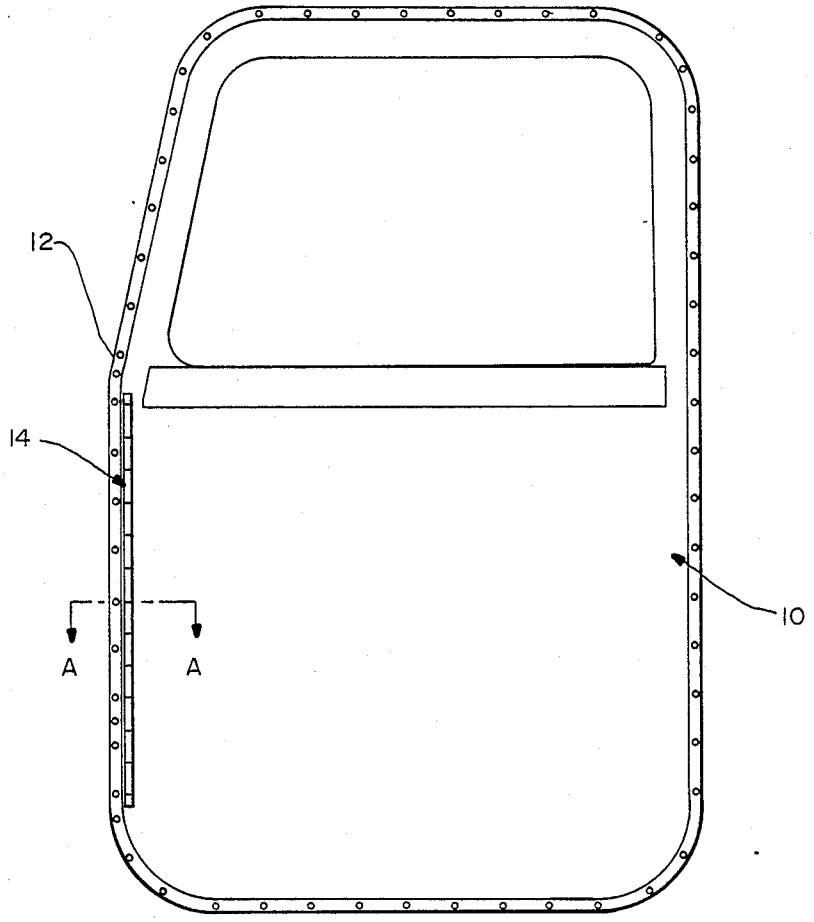
FIG. 1 is a side view of exterior of the hinge assembly of the present invention shown in the specific environment of a turck vehicle door. The rest of the vehicle is not shown.

Referring to FIG. 1, the hinge assembly of the present invention is shown in its preferred general environment, a vehicle door, especially a door forming part of a truck cab. In FIG. 1, door jamb 12 is shown disposed in surrounding relation to door 10; hinge 14 is shown mounted between jamb 12 and door 10, as in a typical truck. Door 10 is shown in FIG. 1 in its closed position.

Figure 2:
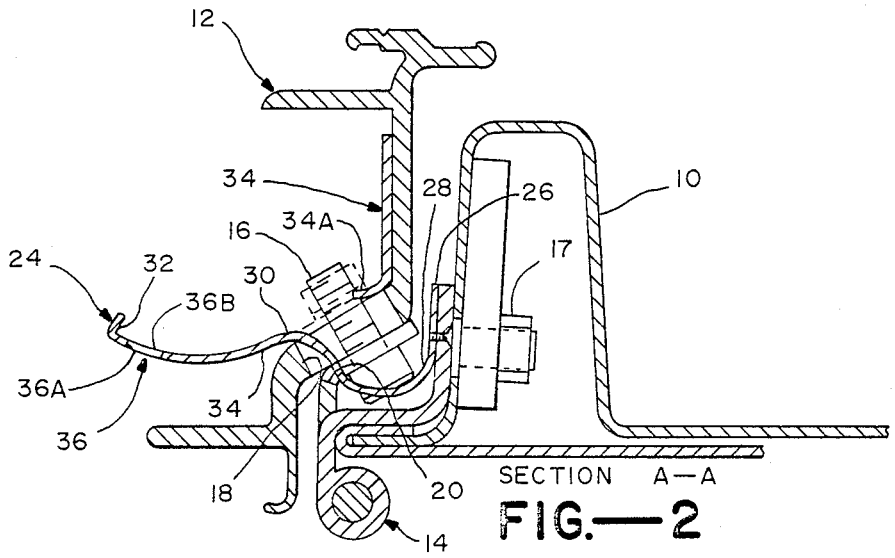
FIG. 2 is a cross-section view of the hinge assembly of the present invention taken along the line A—A of FIG. 1 showing the vehicle door in the closed position.

Referring to FIG. 2, there is shown a cross section view of the present invention taken along the line A—A of FIG. 1. In FIG. 2, hinge 14 is shown mounted between door 10 and door jamb 12 by means of bolt 16 and screw 17. Door jamb 12 and hinge 14 have mated slotted portions, 18 and 20 respectively, forming internal passageway 22 through door jamb 12 and hinge 14. Check means 24 is mounted on hinge 14 and extends through passageway 22.

Check means 24, in its preferred embodiment, comprises a metal ribbon mounted at one end, 26, to hinge 14 by means of rivet 37 and is formed and positioned for resilient deformation upon rotation of door 10. The length dimension of ribbon 24 is calibrated to restrain rotation of door 10 at the first intermediate open position shown in FIG. 3, as will be discussed hereinafter. Check means 24 most preferably is formed having a first curved portion, 28, extending from mounted end 26 to passageway 22 and a second, oppositely curved portion 30 extending from passageway 22 to terminate in flanged end 32. A slot 36 having a front end 36A and a back end 36B extends through the ribbon shaped check means immediately behind flanged end 32.

The hinge assembly of the present invention also includes detent means 34 in the form of a plate, mounted on the interior of door jamb 12 and having an outwardly curved detent 34A for engagement with slot 36 and flanged end 32 of check means 24. Check means 24 is formed for releasable engagement with detent means 34 to permit free rotation of door 10 to the fully open position in a manner to be described fully below.

Figure 3:
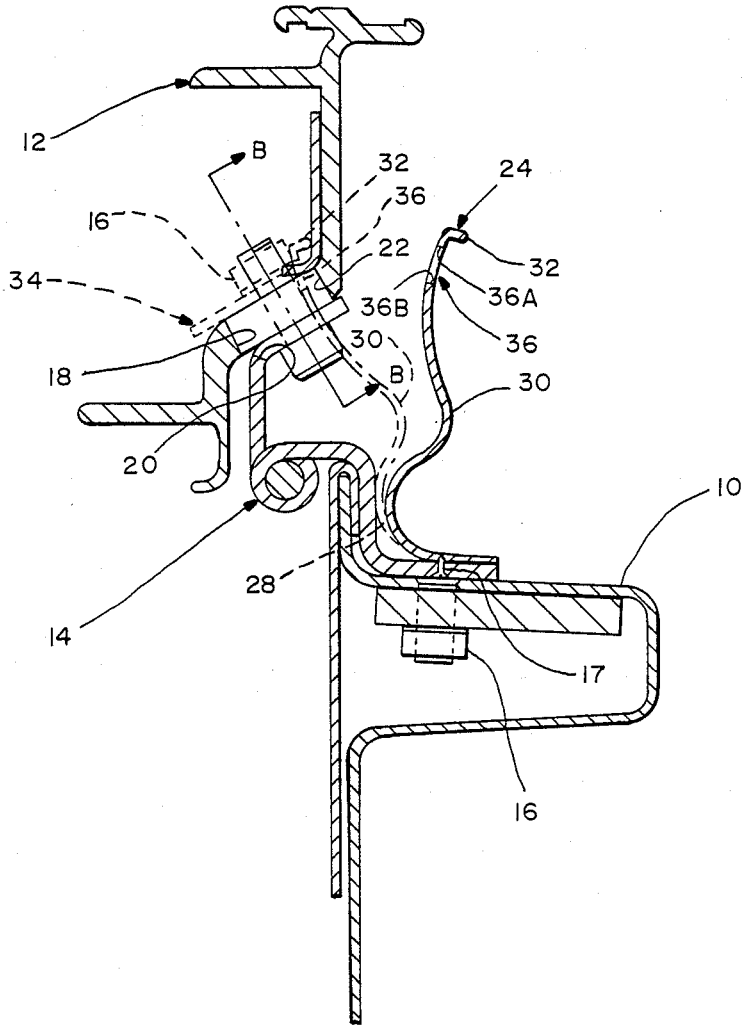
FIG. 3 is the same view as FIG. 2 showing the vehicle door in the primary intermediate open position.

In operation, upon rotation of door 10 from the closed position shown in FIG. 2 to the primary intermediate open position shown in FIG. 3, flanged end 32 and second curved portion 30 of check means 24 move through internal passageway 22, until detent 34A of detent means 34 enters slot 36 of check means 24 and engages with its front end 36A. At this point, rotation of door 10 is restrained at about 90 degrees from the closed position shown in FIG. 2. Further rotation of door 10 toward its fully opened position is restrained by means of interference between detent means 34A and the front end 36A of slot 36. As shown in FIG. 3, that position is about 90 degrees from the closed position shown in FIG. 2.

Figure 4:
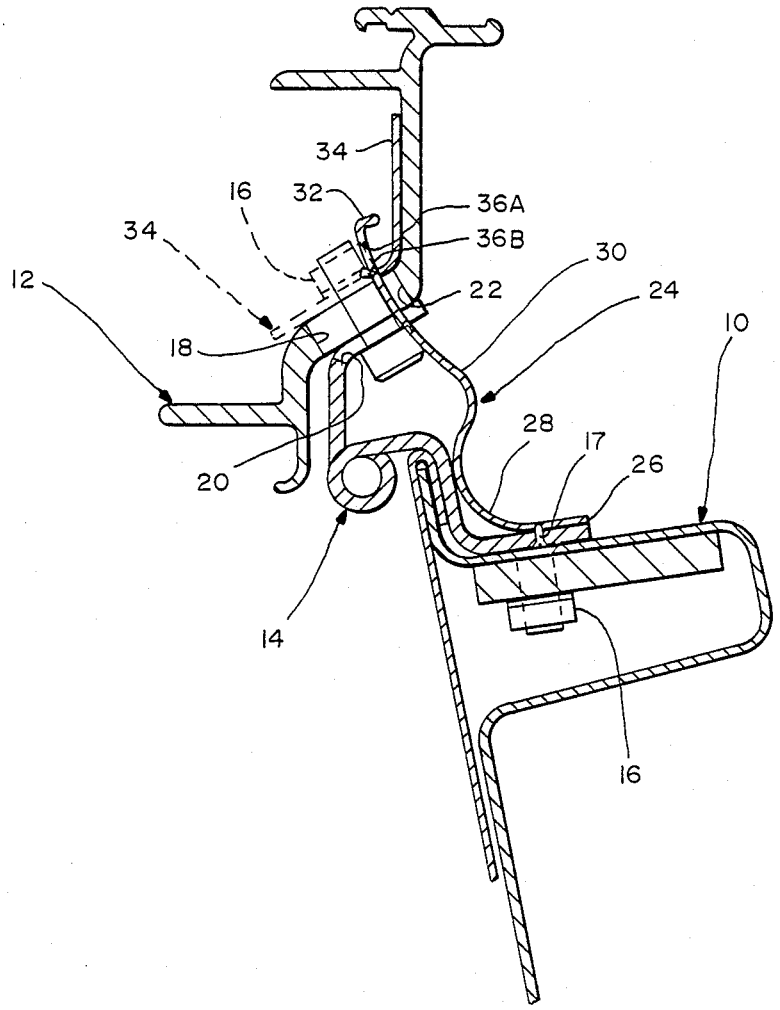
FIG. 4 is the same view as FIG. 2 showing the vehicle door in the secondary intermediate open position.
Figure 5:
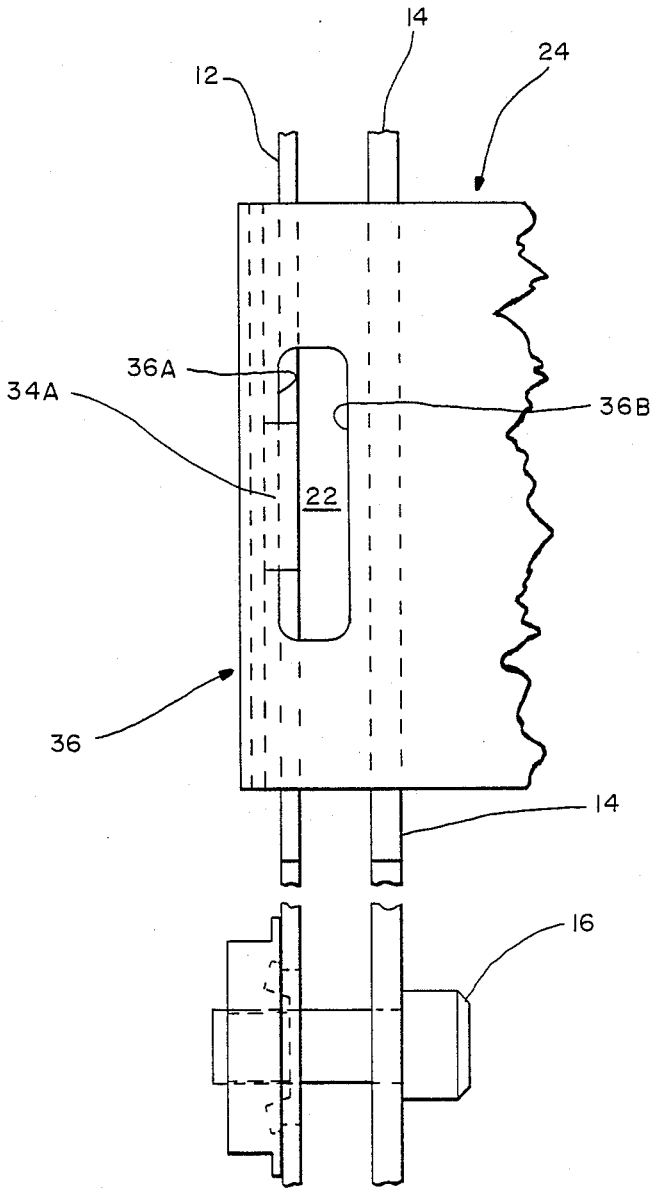
FIG. 5 is a cross-section view of the hinge assembly of the present invention taken along the line B—B of FIG. 3.

With the application of slight force, door 10 can be moved from its primary intermediate open position shown in FIG. 3 to its secondary intermediate open position shown in FIG. 4. This is accomplished by the application of additional force against the door in its closing direction, resulting in further rotation of the door until detent 34A engages backend 36B of slot 36. Interference between detent 34 and the back end, 36B, of slot 36, holds the door in this position approximately 80° from its closed position.

In order to fully open door 10 from its primary intermediate open position, check means 24 may be manually disengaged from detent means 34 by the application of pressure to second curved portion 30 of check means 24. This pressure resiliently deforms check means 24, thereby releasing flanged end 32 from detent means 34 and allowing check flanged end 32 to move all the way through internal passageway 22 and extend into the inside of the assembly as door 10 is rotated further to the fully open position as best seen in FIG. 3.

In the foregoing manner, the advantages of the present invention are obtained.

What is claimed is:

1. A hinge assembly for a vehicle, said vehicle having a door jamb, a door and a hinge mounted therebetween, said door rotatable between closed and fully opened positions, comprising:

an internal passageway defined by mated slotted portions of said hinge and said door jamb;

check means, mounted on said hinge and having a specifically configured free and extending through said passageway; and detent means, mounted on the interior of said door jamb, for engagement with said specifically configured free end of said check means to restrain rotation of said door in a primary intermediate open position, said check means being formed for releasable engagement with said detent means to permit free rotation of said door to said fully opened position.

2. The hinge assembly as defined in claim 1 wherein said specifically configured free end of said check means and said detent means cooperate with one another so as to alternatively restrain rotation of said door in said primary intermediate open position and a less open secondary intermediate position.

3. The hinge assembly as defined in claim 2 wherein said check means includes a metal ribbon, formed and positioned for resilient deformation upon rotation of said door.

4. The hinge assembly as defined in claim 3 wherein said metal ribbon includes a first curved portion extending from said mounted end to said passageway and a second, oppositely curved portion, extending from said passageway to said flanged end, said ribbon having a length dimension calibrated to restrain rotation of said door at said primary intermediate open position, said length dimension and said second curved portion cooperating to restrain rotation of said door at said second intermediate open position.

5. The hinge assembly as defined in claim 4 wherein said primary intermediate open position is about 90 degrees from said closed position.

6. A hinge assembly for a vehicle having a door jamb, a door and a hinge mounted therebetween, said door rotatable between closed and fully opened positions, comprising:

first means movable with said door and second means connected with said jamb, said first and second means cooperating with one another in a first way for maintaining said door open in a primary intermediate position approximately 90° from said closed position, in a second way for maintaining said door open in a secondary intermediate position between said first and closed positions and approximately 80° from said closed position, and in a third way for allowing said door to move to its fully opened position, said first means including a resiliently deformable metal ribbon attached at one end to said door and having a first curved portion extending therefrom, a second, oppositely curved medial portion and a specifically configured flanged end, said ribbon including a slot disposed between said second oppositely curved medial portion and said specifically configured flanged end, said slot having upwardly extending walls and a width dimensioned for receipt of said second means upon rotation of said door to said primary intermediate open position.

7. The hinge assembly according to claim 6 wherein said second portion and said flanged end extend through an internal passageway defined by mating slotted portions of said hinge and said door jamb, and wherein said second means includes a stop, formed and positioned for engagement with said flanged end when said door is opened to said primary intermediate position.

8. The hinge assembly according to claim 7 wherein said first curved portion is disposed in concave relation to the interior of the vehicle and the flange of said specifically configured flanged end is disposed toward the interior of said vehicle.

9. The hinge assembly according to claim 6 wherein said second means includes a detent formed and positioned for engagement with said flanged end when said door is opened to said primary intermediate position.

10. A hinge assembly for a vehicle having a door jamb, a door and a hinge mounted therebetween, said door rotatable between closed and fully opened positions, comprising:

(a) an internal passageway defined by mating slotted portions of said hinge and said door jamb;

(b) a resiliently deformable metal ribbon, attached at one end to said door and having a first curved portion extending therefrom, said first curve portion being disposed in concave relation to the interior of said vehicle, a second, oppositely curved, medial portion, a flanged end having a flange disposed toward the interior of said vehicle, and a channel disposed between said medial portion and said flanged end having upwardly extending walls, said channel and said flanged end extending through said internal passageway in said closed position; and (c) a detent, mounted on the interior of said door jamb for engagement with said flanged end upon rotation of said door; said ribbon being formed for releasable engagement with said detent to permit free rotation of said door to said fully open position.

* * * * *